US005865395A

United States Patent [19]

Wei

[11] Patent Number: 5,865,395

[45] Date of Patent: Feb. 2, 1999

[54] PAPER TOWEL SUPPORTING AND DISPENSING SYSTEM FOR A PAPER TOWEL

[76] Inventor: Kuo-Wei Wei, No. 292-2, Sec. 2, Shan Hsi Rd., Taichung City, Taiwan

[21] Appl. No.: 79,312

[22] Filed: May 15, 1998

[51] Int. Cl.[6] ..... B65H 16/06

[52] U.S. Cl. ..... 242/564.2; 226/127; 226/129; 312/34.16

[58] Field of Search ..... 242/564.1, 564.2; 226/127, 128, 129; 312/34.16, 34.19

[56] References Cited

U.S. PATENT DOCUMENTS

| | | | |
|---|---|---|---|
| 1,703,265 | 2/1929 | Darman | 312/34.16 |
| 2,117,302 | 5/1938 | Darman | 312/34.16 |
| 3,672,552 | 6/1972 | Krueger et al. | 226/129 |
| 4,165,138 | 8/1979 | Hedge et al. . | |
| 4,192,442 | 3/1980 | Bastian et al. | 226/127 |
| 4,260,117 | 4/1981 | Perrin et al. | 242/564.2 |
| 4,611,768 | 9/1986 | Voss et al. . | |
| 4,662,664 | 5/1987 | Wendt et al. | 70/63 |
| 4,664,304 | 5/1987 | Wendt et al. | 226/127 |
| 4,699,304 | 10/1987 | Voss et al. | 226/129 |

*Primary Examiner*—John P. Darling
*Attorney, Agent, or Firm*—Rosenberg, Klein & Bilker

[57] ABSTRACT

A paper towel supporting and dispensing system includes a paper towel supporting unit having hinged support arms releasably forced by a spring to hold a roll of paper towel for dispensing, and a dispensing mechanism having a gear transmission mechanism controlled by a spring supported lever to turn meshed cylinders in letting off the loaded roll of paper towel, the gear transmission mechanism including a transmission gear having a plain section for controlling the dispensing quantity upon each dispensing operation.

2 Claims, 4 Drawing Sheets

PAPER TOWEL SUPPORTING AND DISPENSING SYSTEM FOR A PAPER TOWEL

BACKGROUND OF THE INVENTION

The present invention relates to a paper towel dispenser, and more specifically to a paper towel supporting and dispensing system for a paper towel dispenser.

Various sheet material dispenser means have been disclosed, and have appeared on the market. Exemplars of these designs are seen in U.S. Pat. Nos. 4,165,138; 4,192,442; 4,611,768; 4,662,664; 4,664,304; 4,699,304. Most of the known designs cannot accurately dispense sheet material at a metered length. In one of the aforesaid designs, the user must use one hand to press down a press bar when operating the lever to let off sheet material, so that sheet material is let off at a metered length. Furthermore, according to the conventional designs, a spring wire rod member is mounted between two parallel walls to support a roll of sheet material, enabling the loaded roll of paper material to be dispensed. It is inconvenient to load a roll of sheet material on the spring wire rod member, and the spring power of the spring wire rod member wears quickly with use.

SUMMARY OF THE INVENTION

The present invention has been accomplished to provide a paper towel supporting and dispensing system for a paper towel dispenser which eliminates the aforesaid drawbacks. It is one object of the present invention to provide a paper towel supporting and dispensing system which automatically dispenses the loaded roll of paper towel at a metered length. It is another object of the present invention to provide a paper towel supporting and dispensing system which enables the user to install a roll of paper towel in the system easily and quickly.

DETAILED DESCRIPTION OF THE PREFERRED EMBODIMENT

Figure 1:
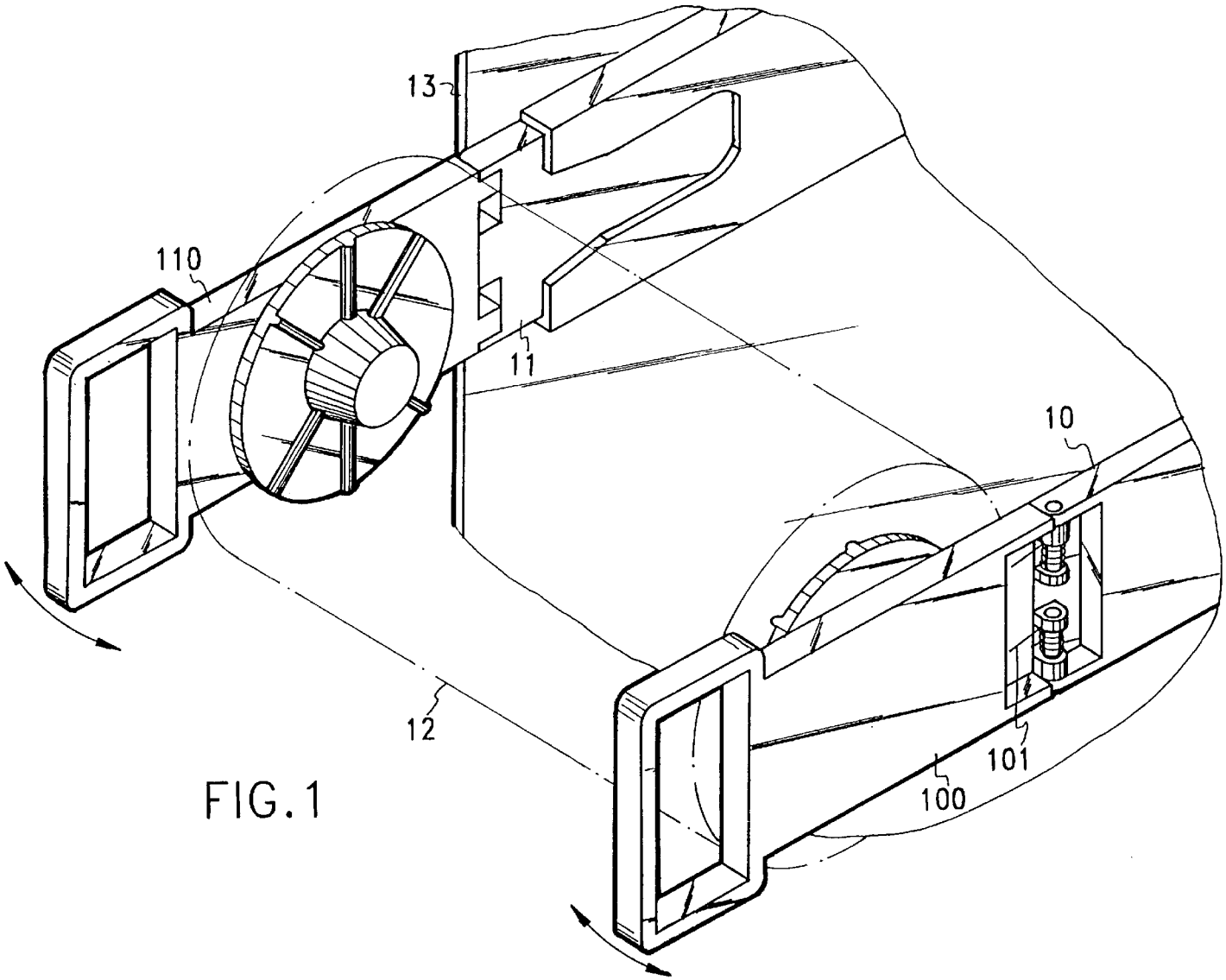
FIG. 1 is a perspective view of a part of the present invention, showing a roll of paper towel supported between the support arms.

Referring to FIG. 1, a paper towel dispenser in accordance with the present invention is generally comprised of a casing 13, two parallel fixed bars 10;11 bilaterally mounted in the casing 13, two support arms 100;110 respectively hinged to the fixed bars 10;11, and two spring devices 101 respectively connected between the fixed bars 10;11 and the support arms 100;110 to hold the support arms 100;110 in longitudinal alignment with the fixed bars 10;11. When the support arms 100;110 are turned outwards, a roll of paper towel 12 is loaded and secured between the support arms 100;110.

Figure 2:
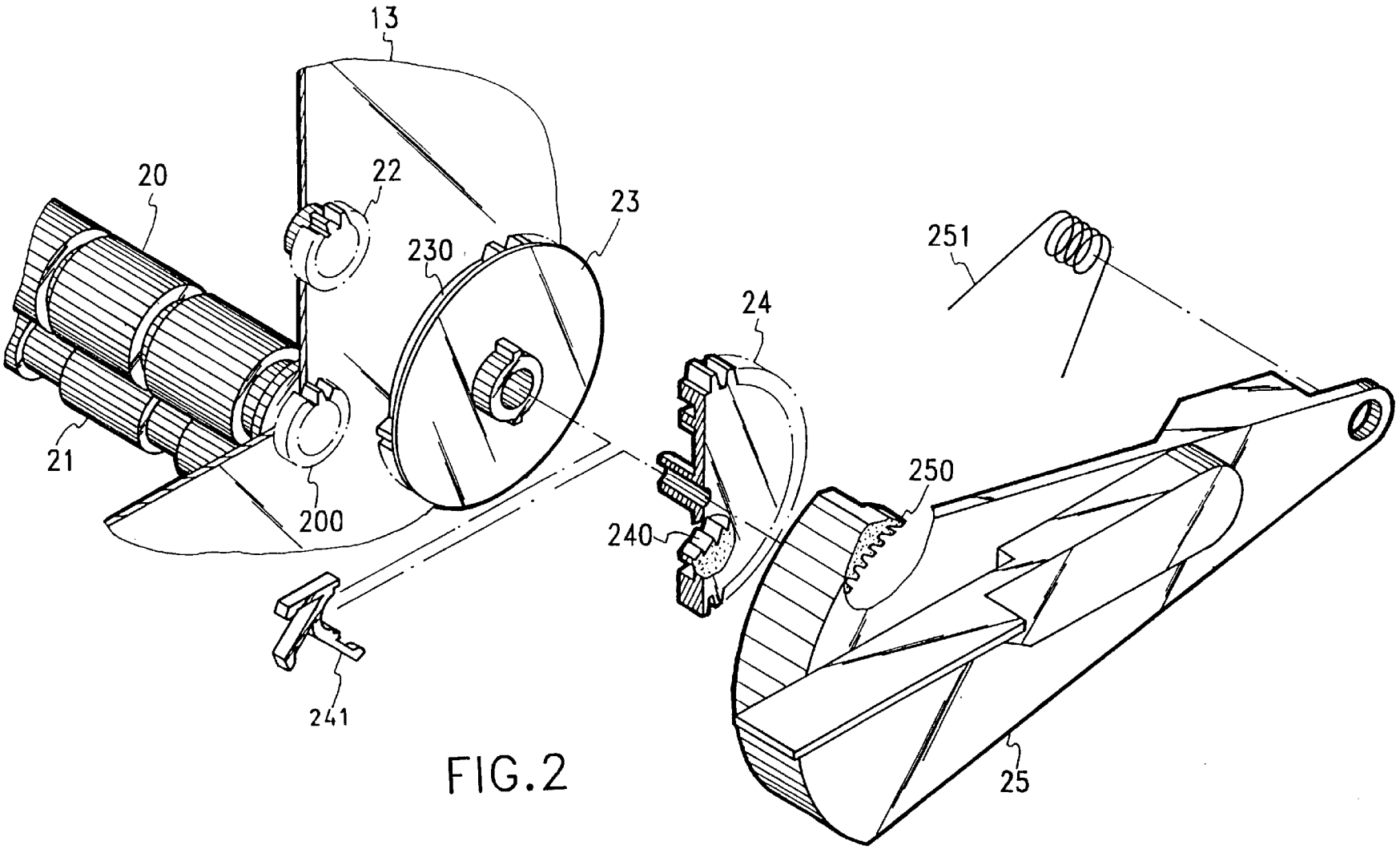
FIG. 2 is an exploded view of the dispensing mechanism of the paper towel supporting and dispensing system according to the present invention.

Referring to FIG. 2, the paper towel dispenser further comprises a dispensing mechanism mounted in the casing 13, and controlled to dispense the loaded roll of paper towel at a metered length. The dispensing mechanism comprises a sheet-transfer cylinder 20 and an impression cylinder 21 arranged in parallel and revolvably supported in the casing 13, a driven gear 200 fixedly mounted on one end of the sheet-transfer cylinder 20 outside the casing 13, a driving gear 22 revolvably supported on one side wall of the casing 13 and spaced above the driven gear 200, a transmission gear 23 meshed with the driving gear 22 and the driven gear 200, a brake gear 24 coupled to the transmission gear 23 at one side, the brake gear 24 having an internal ratchet 240, a plurality of pawls 241 fixedly fastened to the transmission gear 23 and meshed with the internal ratchet 240 of the brake gear 24, a lever 25 having one end pivoted to the casing 13 on the outside and an opposite end integral with a rack 250, the rack 250 being meshed with the driving gear 22, and a torsional spring 251 connected between the casing 13 and the lever 25 to hold the lever 25 at a position. The transmission gear 23 has a plain section 230 at the toothed periphery. When the plain section 230 is moved into contact with the driven gear 200 during the rotary motion of the transmission gear 23, the driven gear 200 is not rotated, and therefore the sheet-transfer cylinder 20 is stopped from letting off the loaded roll of paper towel.

Figure 3:
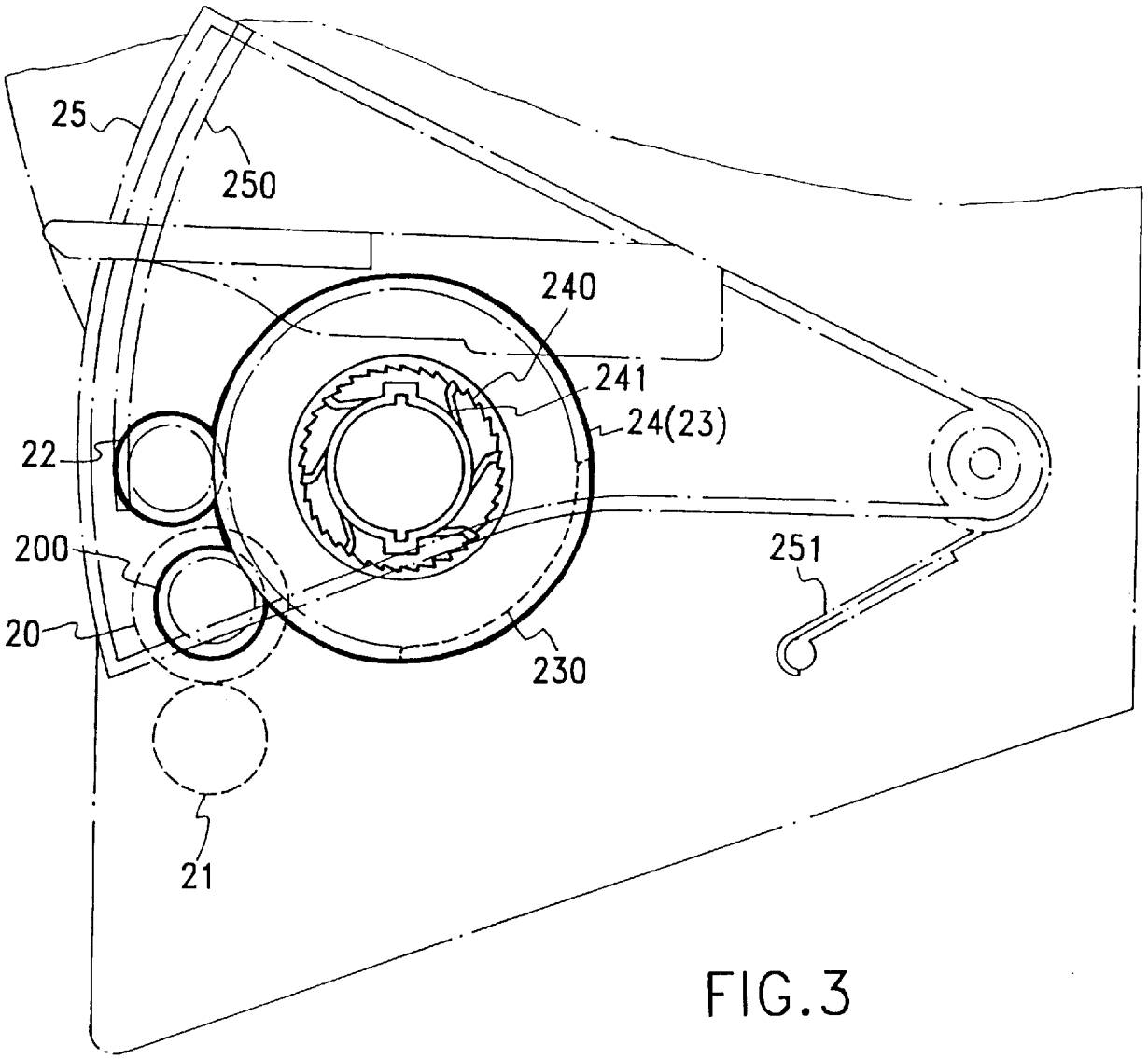
FIG. 3 is a side plain view of the dispensing mechanism of the paper towel supporting and dispensing system according to the present invention.
Figure 4:
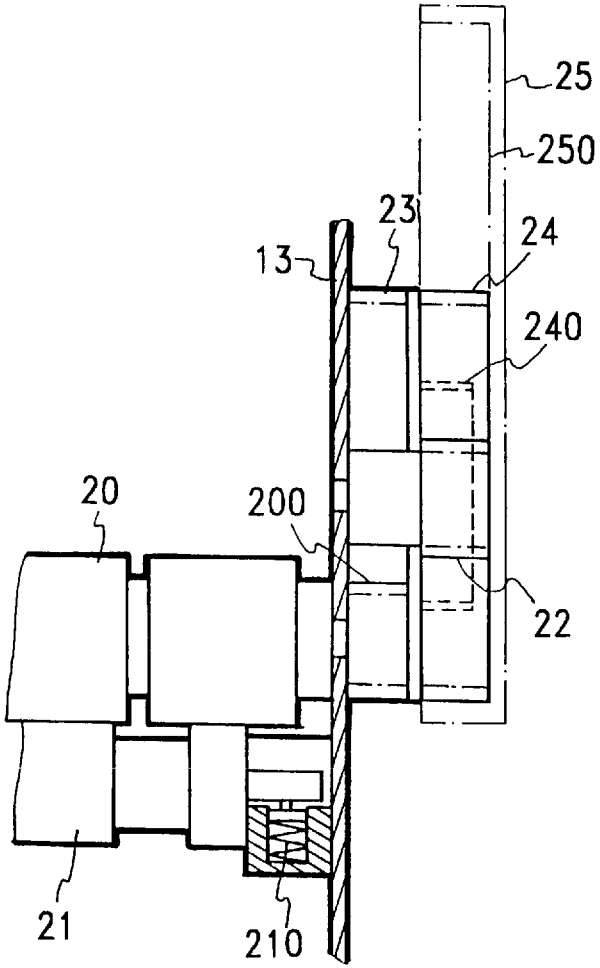
FIG. 4 is a front plain view of the dispensing mechanism of the paper towel supporting and dispensing system according to the present invention.

Referring to FIGS. 3 and 4, when the lever 25 is turned downwards, the driving gear 22 is rotated by the rack 250 of the lever 25, causing the brake gear 24 and the transmission gear 23 to make a rotary motion. When the transmission gear 23 is rotated, the driven gear 200 is synchronously rotated, causing the sheet-transfer cylinder 20 to rotate the impression cylinder 21 by means of friction resistance, and therefore the loaded roll of paper towel is let off. When the plain section 230 of the transmission gear 23 is moved to the driven gear 200 during the rotary motion of the transmission gear 23, the driving power disappears, and the rotary motion of the sheet-transfer cylinder 20 is stopped, and therefore the dispensing of the loaded roll of paper towel is stopped. When the lever 25 is released from the hand, it is immediately returned to its former position by the torsional spring 251. When the lever 25 is returned to its former position, the driving gear 22 and the brake gear 24 are rotated in the reversed direction without turning the transmission gear 23 (because of the engagement between the internal racket 240 and the pawls 241). When the lever 25 is turned downwards again, the brake gear 24 and the transmission gear 23 are rotated by the driven gear 22 again, causing the driven gear 200 to rotate the impression cylinder 21 through the sheet-transfer cylinder 20, and therefore the roll of paper towel is dispensed at a metered length again.

Furthermore, spring means 210 is provided to impart a pressure to the impression cylinder 21 against the sheet-transfer cylinder 20, enabling the lead end of the loaded roll of paper towel to be positively carried in between the sheet-transfer cylinder 20 and the impression cylinder 21.

While only one embodiment of the present invention has been shown and described, it will be understood that various modifications and changes could be made thereunto without departing from the spirit and scope of the invention disclosed.

What the invention claimed is:

1. A paper towel supporting and dispensing system comprising a supporting unit mounted in a casing to support a roll of paper towel, and a dispensing mechanism driven to dispense loaded roll of paper towel at a metered length, said dispensing mechanism comprising a sheet-transfer cylinder and an impression cylinder rotated in reversed directions to dispense the loaded roll of paper towel;

a driven gear fixedly mounted on one end of said sheet-transfer cylinder outside the casing;

a driving gear turned about a point at the casing;

a transmission gear meshed with said driving gear and said driven gear, said transmission gear having a plain section at the periphery;

a brake gear coupled to said transmission gear at one side, said brake gear having an internal ratchet;

pawl means fixedly fastened to said transmission gear and meshed with the internal ratchet of said brake gear;

a lever having one end pivoted to said casing on the outside and an opposite end integral with a rack, said rack being meshed with said driving gear; and a torsional spring connected between said casing and said lever to hold said lever at a position;

wherein when said lever is pressed down, said transmission gear and said brake gear are rotated to turn said sheet-transfer cylinder through said driven gear, causing said loaded roll of paper towel to be dispensed, said driven gear is stopped from rotating said sheet-transfer cylinder when the plain section of said transmission gear is moved to said driven gear during the rotary motion of said transmission gear; said transmission gear is stopped from rotating said driven gear when said driven gear is driven by said lever to rotate in the reversed direction during the return stroke of said lever.

2. The paper towel supporting and dispensing system of claim 1 wherein said supporting unit comprises two parallel fixed bars fixedly mounted in the casing, two support arms respectively hinged to said fixed bars, and spring means respectively connected between said fixed bars and said support arms, enabling a roll of paper towel to be loaded and revolvably supported between said support arms.

* * * * *